US007074741B2

(12) United States Patent
Sugita et al.

(10) Patent No.: US 7,074,741 B2
(45) Date of Patent: Jul. 11, 2006

(54) SUBLIMATION THERMAL TRANSFER RECORDING MEDIUM AND THERMAL TRANSFER RECORDING METHOD USING THE SAME

(75) Inventors: Junichirou Sugita, Tochigi (JP); Youichi Shutara, Tochigi (JP); Morio Sekiguchi, Tochigi (JP)

(73) Assignees: Sony Corporation, Tokyo (JP); Sony Chemicals Corporation, Tokyo (JP)

( * ) Notice: Subject to any disclaimer, the term of this patent is extended or adjusted under 35 U.S.C. 154(b) by 217 days.

(21) Appl. No.: 10/869,993

(22) Filed: Jun. 16, 2004

(65) Prior Publication Data

US 2004/0266620 A1 Dec. 30, 2004

(30) Foreign Application Priority Data

Jun. 24, 2003 (JP) ..... P2003-179813

(51) Int. Cl.
*B41M 5/035* (2006.01)
*B41M 5/38* (2006.01)

(52) U.S. Cl. ..... 503/227

(58) Field of Classification Search ..... 503/227
See application file for complete search history.

(56) References Cited

FOREIGN PATENT DOCUMENTS

| | | |
|---|---|---|
| JP | 9-234963 | 9/1997 |
| JP | 10-297123 | 11/1998 |

*Primary Examiner*—Bruce H. Hess
(74) *Attorney, Agent, or Firm*—Bell, Boyd & Lloyd LLC

(57) ABSTRACT

A sublimation thermal transfer recording medium and a thermal transfer recording method that can remove background stain and the like, and can realize gradation printing with high accuracy and good correlation between the heat quantity applied and the coloring density are provided. The sublimation thermal transfer recording medium includes a base sheet having formed on one surface thereof a number of thermal transfer dye layers having different hues in parallel to each other. The thermal transfer dye layers contain a resin material having a weight average molecular Mw of about 100,000 or less, and preferably about 60,000 or less, as a main component of a binder resin, and contain a block copolymer silicone resin. The silicone resin preferably includes an amount of Si that ranges from about 5% to about 30% by weight, and a mixing ratio of the resin material and the silicone resin is preferably from about 99:1 to about 70:30.

5 Claims, 2 Drawing Sheets

SUBLIMATION THERMAL TRANSFER RECORDING MEDIUM AND THERMAL TRANSFER RECORDING METHOD USING THE SAME

CROSS REFERENCES TO RELATED APPLICATIONS

This application claims priority to Japanese Patent Application No. P2003-179813 filed on Jun. 24, 2003, the disclosure of which is incorporated by reference herein.

BACKGROUND OF THE INVENTION

The present invention relates to a sublimation thermal transfer recording medium used as an ink ribbon for a sublimation thermal transfer printer and the like. More particularly, the present invention relates to an improvement in resin composition of a thermal transfer dye layer. The present invention also relates to a thermal transfer recording method using the sublimation thermal transfer recording medium.

The thermal transfer recording system using a sublimation dye transfers a large number of color dots to a transfer medium by heating in an extremely short period of time to reproduce a full color image according to an original copy with the color dots of multiple colors.

In the thermal transfer recording system, such a thermal transfer recording medium is used as an ink ribbon that has a base film, such as a polyester film, having formed on one surface thereof a thermal transfer dye layer containing a thermal transfer dye (sublimation dye). The thermal transfer dye layer is superimposed on printing paper, and the back surface of the thermal recording medium is heated according to image information with a thermal head or the like to transfer the sublimation dye contained in the thermal transfer dye layer to the printing paper, whereby a desired dye image is formed. In the case where a full color image is to be formed, thermal transfer dye layers of three colors, yellow, magenta and cyan, which are formed on one surface of the thermal transfer recording medium in parallel to each other, are sequentially superimposed on printing paper to subject to the thermal printing operation. It is also practiced that a thermal transfer dye layer of black color is transferred in addition to those of three colors to form a black image with higher density.

It is important in the thermal transfer recording medium of this type that a printed matter colors in a high density, and the medium causes no failure, such as fusion bonding, with respect to a receiving material, such as printing paper. In this point of view, a vinyl resin, such as polyvinyl chloride, or a cellulose resin has been used as a binder resin of the thermal transfer dye layer of the thermal transfer recording medium.

In order to prevent fusion bonding, it has been also proposed that a silicone graft polymer obtained by modifying an acrylic, polyester, styrene or urethane polymer with silicone, a silicone oil, a phosphate ester and a fluorine surface active agent are added in a small amount to the thermal transfer dye layer as described, for example, in JP-A-9-234963.

In the sublimation thermal transfer recording system, it is demanded that an image with a continuous density from low tone to high tone can be printed, and the thermal transfer dye layer of the thermal transfer recording medium exhibits good correlation between the heat quantity applied and the coloring density, whereby printing with highly accurate gradation is realized.

In the thermal transfer dye layer of the thermal transfer recording medium, a resin having a molecular weight of 100,000 or more and a high glass transition point Tg (about from 70° C. to 90° C.) is generally used as a binder resin to prevent background stain due to after heat of the thermal head from occurring.

In the case where the binder resin has a large molecular weight, however, an ink for forming the thermal transfer dye layer has a high viscosity upon preparation thereof to cause difficulty in production of the thermal transfer recording medium. The binder resin having a large molecular weight is also inert in thermal behavior due to the high glass transition point Tg, and thus it provides a low maximum printing density to cause a problem of shortage in printing density upon applying the medium to high speed printing. In the case where a thermal transfer recording medium having a thermal transfer dye layer using a binder resin having a large molecular weight is used, and an image is directly printed on a surface of a plastic card, such as soft vinyl chloride (containing about 50% of a plasticizer for vinyl chloride), the coloring density is further lowered due to hardness of the plastic card.

In order to solve the problems, it is considered that the glass transition point Tg and the molecular weight of the binder resin used in the thermal transfer dye layer are lowered, but in this case, while the total transferability is improved, another problem arises that background stain occurs on the non-printed area, and high density coloration quickly occurs before the heat quantity is sufficiently increased. Therefore, it is difficult that the background stain is prevented, and printing with accurate gradation owing to good correlation between the heat quantity applied and the coloring density is realized, only by setting the molecular weight and the glass transition point Tg of the binder resin of the thermal transfer dye layer.

On the other hand, it has been attempted that the properties of the thermal transfer dye layer of the sublimation transfer recording medium are improved by adding a silicone material to the thermal transfer dye layer, so as to obtain a sharp printed image. In the case where the silicone material is added to the thermal transfer dye layer, silicone chains are bled out to the surface with the lapse of time to provide an effect of preventing fusion bonding to the receiving material. In the technique disclosed in JP-A-9-234963, a sharp image can be obtained by using a silicone-modified polymer.

However, the silicone-modified polymer used in JP-A-9-234963 is a graft polymer having such a structure that silicone chains are introduced to the main chain (for example, an acrylic chain) in a branched form. Therefore, the silicone chains as side chains are bled out to exhibit the releasing effect, but the main chain remains to stay in the binder to exhibit substantially no barriering effect to the dye. As a result, background stain occurs.

It is considered that the addition of the releasing agent, such as the aforementioned silicone-modified polymer, in a large amount may lower the coloration to suppress the background stain and the like in a certain extent. However, in the case where an ordinary releasing agent or a silicone-modified polymer, such as that disclosed in JP-A-9-234963, is added in such an amount that the state is exhibited, other problems newly arise, such as separation of the dye and repelling thereof upon coating.

SUMMARY OF THE INVENTION

The present invention relates to a sublimation thermal transfer recording medium used as an ink ribbon for a sublimation thermal transfer printer and the like. More specifically, the present invention relates to an improvement in resin composition of a thermal transfer dye layer and a thermal transfer recording method using the sublimation thermal transfer recording medium.

The inventors have discovered that both the prevention of background stain and an improvement in maximum printing density can be simultaneously realized, and gradation printing with high accuracy and good correlation between the heat quantity applied and the coloring density can be attained, by using both a resin material having a small molecular weight as a main component of the binder resin and a block copolymer silicone resin that has a silicone chain introduced into the main chain.

To this end, the present invention provides in an embodiment a sublimation thermal transfer recording medium that has a base sheet having formed on one surface thereof a number of thermal transfer dye layers that have different hues in parallel to each other. The thermal transfer dye layers include a resin material that has a weight average molecular Mw of about 100,000 or less and contains a block copolymer silicone resin.

In an embodiment, a resin material that has a weight average molecular Mw of about 100,000 or less is used as a main component of a binder resin of the thermal transfer dye layer, wherein good thermal behavior is obtained to provide good correlation between the heat quantity applied and the coloring density and a high maximum printing density.

The block copolymer silicone resin in an embodiment has a main chain that migrates to the vicinity of the surface upon bleeding out the silicone chains, so as to provide high barriering effect to the dye. Therefore, the proportion of the dye on the surface of the thermal transfer dye layer is lowered, and thus coloration does not readily occur after heat of the thermal head thereby effectively eliminating background stain.

Furthermore, the block copolymer silicone resin in an embodiment does not contain a silicone terminal group, which impairs compatibility and solubility with respect to the binder resin, such as the resin material having a weight average molecular weight Mw of about 100,000 or less. This allows a uniform formation of the thermal transfer dye layer. This not only suppresses diffusion of the dye, but also effectively eliminates the problems associated with separation of a dye and repelling thereof upon coating.

In another embodiment, the present invention provides a thermal transfer recording method. The method includes making a receiving material in contact with a sublimation thermal transfer recording medium, and applying heat to a back surface of the sublimation thermal transfer recording medium to effect printing on the receiving material. The sublimation thermal transfer recording medium has a thermal transfer dye layer that contains a resin material having a weight average molecular Mw of 100,000 or less and containing a block copolymer silicone resin, and wherein the printing is effected directly on a surface of a soft vinyl chloride card as the receiving material.

As described in the foregoing, the use of the sublimation thermal transfer recording medium pursuant to an embodiment of the present invention enables high density printing and effectively eliminates the problem of background stain. Therefore, even when the receiving material is a soft vinyl chloride card, sufficient coloring density can be obtained, and gradation printing with high accuracy and good correlation between the heat quantity applied and the coloring density can be realized.

An advantage of the present invention is to provide a sublimation thermal transfer recording medium and a thermal transfer recording method that can remove background stain and the like.

Another advantage of the present invention is to provide a sublimation thermal transfer recording medium and a thermal transfer recording method that can realize gradation printing with high accuracy and a desirable correlation between the heat quantity applied and the coloring density.

Yet another advantage of the present invention is to provide a sublimation thermal transfer recording medium that effectively eliminates separation of dye and repelling thereof upon forming a thermal transfer dye layer.

Additional features and advantages of the present invention are described in, and will be apparent from, the following Detailed Description of the Invention and the figures.

DETAILED DESCRIPTION OF THE INVENTION

The present invention generally relates to a sublimation thermal transfer recording medium used as an ink ribbon for a sublimation thermal transfer printer and the like. More specifically, the present invention relates to an improvement in resin composition of a thermal transfer dye layer and also relates to a thermal transfer recording method using the sublimation thermal transfer recording medium. The sublimation thermal transfer recording medium and the thermal transfer recording method according to various embodiments of the present invention will be described in detail below with reference to the drawings.

Figure 1:
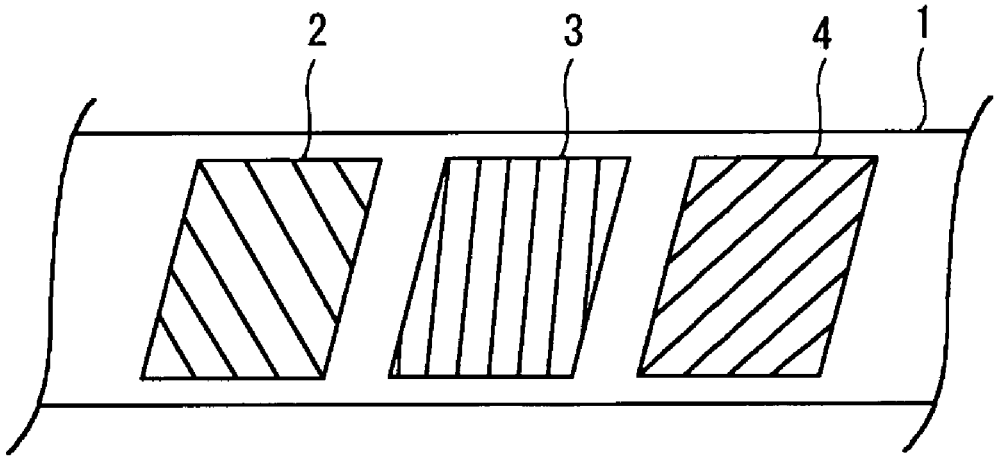
FIG. 1 is a schematic perspective view that illustrates a sublimation thermal transfer recording medium according to an embodiment of the present invention.

The sublimation thermal transfer recording medium has a base sheet having formed on one surface thereof a number of thermal transfer dye layers that have different hues in parallel to each other. For example, as shown in FIG. 1, a yellow thermal transfer dye layer 2, a magenta thermal transfer dye layer 3 and a cyan thermal transfer dye layer 4 are formed on one surface of a base sheet 1 in parallel to each other.

The sublimation thermal transfer recording medium having the aforementioned constitution may further have, on regions among the thermal transfer dye layers 2, 3 and 4, a transparent transfer layer for preventing a dye having been transferred to the receiving material from retransferring onto the sublimation thermal transfer recording medium and for receiving a dye to be transferred next. The base sheet 1 of the sublimation thermal transfer recording medium may have, depending on necessity, a sensor mark or the like for detecting the position of the sublimation thermal transfer recording medium. The thermal transfer dye layers are not limited to the three colors as described above, and can include any suitable number, color and type thereof. For example, a black thermal transfer dye layer may be additionally formed. Furthermore, an image protecting layer may be provided, which is transferred on a completed image after forming the image with the thermal transfer dye layers 2, 3 and 4.

In the sublimation thermal transfer recording medium of the invention, it is a general constitution that the thermal transfer dye layers 2 to 4 contain sublimation dyes of yellow, magenta and cyan colors, respectively, as described in the foregoing, and the dyes contained in the thermal transfer dye layers can include various kinds of known sublimation dyes. Examples of the yellow dye include an azo dye, a disazo dye, a methine dye, a styryl dye, a pyridone-azo dye, the like, a mixed system thereof and combinations thereof. Examples of the magenta dye include an azo dye, an anthraquinone dye, a styryl dye, a heterocyclic azo dye, the like, and a mixed system thereof. Examples of the cyan dye include an anthraquinone dye, a naphthoquinone dye, a heterocyclic azo dye, an indoaniline dye, the like and a mixed system thereof. In the case where the black thermal transfer dye layer is provided, any suitable and known black dye can be used.

The thermal transfer dye layers 2 to 4 each is constituted from the aforementioned sublimation dye and a binder resin, and the binder resin contains, as a main component, a resin material having a weight average molecular weight Mw of about 100,000 or less, and preferably about 60,000 or less. In the case where the molecular weight of the main component of the binder resin exceeds the aforementioned range, the glass transition point Tg of the thermal transfer dye layers 2 to 4 is increased to cause shortage in maximum printing density.

The resin material used as the binder resin can include any suitable material. Usable examples thereof include a water soluble resin, such as a cellulose resin and an acrylic acid resin, an acrylic resin, polyphenylene oxide, polysulfone, polyethersulfone, ethylcellulose, acetylcellulose, polystyrene, polyvinylbutyral, polycarbonate, a methacrylic resin, an acrylonitrile-styrene copolymer, a polyester resin, an epoxy resin, a urethane resin, chlorinated polyethylene, chlorinated polypropylene, and the like. Among these, polyvinylbutyral (PVB), an epoxy resin, polyesterurethane and the like are preferred.

In the sublimation thermal transfer recording medium of the invention, the thermal transfer dye layers 2 to 4 contain a block copolymer silicone resin in addition to the aforementioned main component of the binder resin. Examples of the block copolymer silicone resin include a polydimethylsiloxane block copolymer or the like, and in particular, an acrylic silicone block copolymer (a block type acrylic modified silicone resin) is preferred. The polydimethylsiloxane block copolymer can be produced, for example, by copolymerizing a vinyl monomer using an azo group-containing polydimethylsiloxameamide as an initiator or by other suitable process. The polydimethylsiloxane block copolymer is described in detail in JP-A-10-297123, and those disclosed in JP-A-10-297123 can be used in the invention.

In general, the addition of a large amount of a releasing agent for preventing adhesion to a receiving material causes somewhat deterioration in coloration. It is considered that this is because the silicone component of the releasing agent thus added is deposited on the surface of the thermal transfer recording medium with the lapse of time to barrier transfer of a dye. The critical surface tension of the thermal transfer recording medium in this state is generally a small value. However, in the case where an ordinary releasing agent is added in such an amount that the state is exhibited, other problems can arise, such as separation of the dye and repelling thereof upon coating. In the case where a graft type silicone-modified polymer is used, unreacted groups present in the graft chains can cause repelling and inhibition of dissolution to provide a deteriorated coated form. In a microscopic view, the use of the graft silicone-modified polymer results in deteriorated compatibility with the main component of the binder resin and the dye, so as to provide a small effect of suppressing excessive transfer of the dye.

In the case where the block copolymer silicone resin is used, on the other hand, there is no silicone terminal group, which impairs compatibility and solubility, whereby the thermal transfer dye layer can be formed uniformly in comparison to a graft type silicone-modified polymer having a molecular weight and a glass transition point Tg equivalent thereto, so as to provide a large effect of suppressing diffusion of the dye to the receiving material. Furthermore, the critical surface tension on the surface of the thermal transfer recording medium is significantly decreased to improve the effect as a releasing agent.

In the block copolymer silicone resin, the amount of Si contained is preferably from about 5% to about 30% by weight. In the case where the Si amount is too small, the intended effect cannot be obtained, and in the case where it is too large, there is such a possibility that problems can arise in compatibility and solubility. The mixing ratio of the main component of the binder resin and the block copolymer silicone resin is preferably in a range of from about 99:1 to about 70:30. In the case where the proportion of the silicone resin is lower than the range, the intended effect cannot be obtained, and in the case where it exceeds the range, there is such a possibility that problems arise in compatibility and solubility.

The thermal transfer dye layers 2 to 4 can be formed by a known method. For example, the sublimation dye, the binder resin and the block copolymer silicone resin are dissolved or dispersed in a solvent to form a coating composition, which is then coated on one surface of the base sheet, followed by drying, to produce the thermal transfer dye layer. The thickness of the thermal transfer dye layers 2 to 4 is not particularly limited and is, for example, preferably from about 0.2 μm to about 5 μm.

The base sheet 1 can be formed with various known base materials. Examples thereof include a polyester film, a polystyrene film, a polypropylene film, a polysulfone film, a polycarbonate film, a polyimide film, an aramid film, the like, and combinations thereof. The thickness of the base sheet 1 generally ranges from about 1 μm to about 30 μm, and preferably from about 2 μm to about 10 μm. The surface of the base sheet 1, on which no thermal transfer dye layer is formed, can be subjected to a heat resistant treatment or the like for preventing fusion bonding to a heating member used upon thermal transfer, such as a thermal head.

The thermal transfer recording using the sublimation thermal transfer recording medium of the invention can be carried out by using an ordinary sublimation printer or the like in an ordinary method. In this regard, a receiving material is made in contact with the thermal transfer dye layer of the sublimation thermal transfer recording medium, and heat is applied to the back surface of the sublimation thermal transfer recording medium with a thermal head or the like to effect printing on the receiving material.

The receiving material used herein can be an arbitrary receiving material, and by using the sublimation thermal transfer recording medium of the invention, printing can be effected directly on a hard surface of a soft vinyl chloride card. There is such a tendency that the coloring density on the surface of the soft vinyl chloride card is lowered due to the hardness thereof, but the use of the sublimation thermal transfer recording medium of the invention enables gradation printing with high accuracy, sufficient coloring density and good correlation between the heat quantity applied and the coloring density.

In the case where printing is effected directly on the surface of the soft vinyl chloride card, a thin layer of the block copolymer silicone resin may be formed on one or both of the surface of the thermal transfer dye layer and the surface of the soft vinyl chloride card. In this case, the block copolymer silicone resin may not be added to the thermal transfer dye layer.

EXAMPLE

The present invention will be specifically described with reference to the following examples without limitation to the scope of the present invention.

Examples 1 to 3 and Comparative Examples 1 and 2

A heat resistant layer was formed on a back surface of a polyethylene terephthalate film having a thickness of 6 μm, and an adhesive undercoating layer was formed on a front surface thereof. A thermal transfer dye layer of cyan color was formed by coating on the undercoating layer to produce a sublimation thermal transfer recording medium (sublimation thermal transfer ribbon). The cyan thermal transfer dye layer was formed by coating with a coil bar a coating composition containing a resin and a releasing agent shown in Table 1 below to provide a dry thickness of 1.0 μm. A dye used in the coating composition was Sumiplast Blue OA, a trade name, produced by Sumitomo Chemical Co., Ltd., and a solvent used therein was methyl ethyl ketone, cyclohexanone and N-methylpyrrolidone.

The binder resins and the releasing agents referred in Table 1 were as follows.

PVB1: Denka Butyral #3000K, a trade name, produced by Denki Kagaku Kogyo Co., Ltd. (Mw: about 60,000);

PVB2: Denka Butyral #6000C, a trade name, produced by Denki Kagaku Kogyo Co., Ltd. (Mw: about 150,000);

Polyester polyurethane: Vylon UR1400, a trade name, produced by Toyobo, Co., Ltd. (Mw: about 40,000);

Epoxy: Epicote 1010, a trade name, produced by Japan Epoxy Resin Co., Ltd. (Mw: 5,000 to 6,000);

Block type releasing agent: Acrylic-silicone block copolymer varnish, SX082, a trade name, produced by Natoco Co., Ltd.; and Graft type releasing agent: Acrylic-silicone graft copolymer varnish, US-380, a trade name, produced by Toagosei Co., Ltd.

TABLE 1

| | Binder resin | Releasing agent | Si ratio (%) | P/B |
|---|---|---|---|---|
| Example 1 | PVB1 | block type | 10 | 0.85 |
| Example 2 | polyester polyurethane | block type | 10 | 1.00 |
| Example 3 | Epoxy | block type | 10 | 0.85 |
| Comparative Example 1 | PVB1 | graft type | 10 | 0.85 |
| Comparative Example 2 | PVB2 | block type | 10 | 1.00 |

Evaluation Method

The sublimation thermal transfer recording media of Examples and Comparative Examples were measured for γ characteristics by subjecting to a printing test in a single cyan color with varying head energy.

Printer: Card Printer, P-310C, a trade name, produced by Eltron International, Inc.

Receiving material: Soft vinyl chloride card

Printing density measuring device: Macbeth Reflection Densitometer TR924, a trade name, produced by Gretag Macbeth, Inc.

Figure 2:
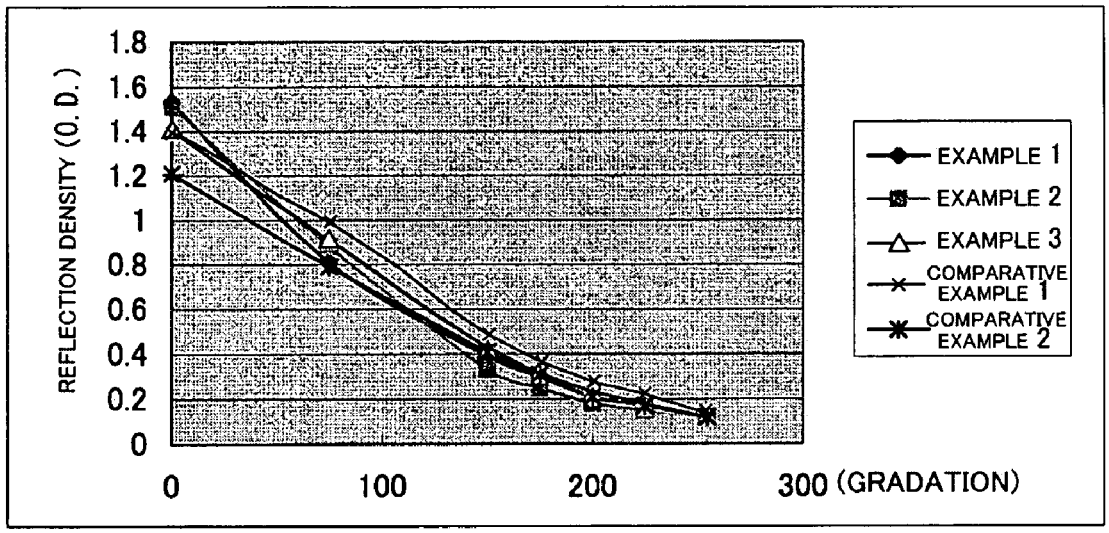
FIG. 2 is a graph showing γ curves of Examples and Comparative Examples.

The results obtained are shown in Table 2 below and FIG. 2.

TABLE 2

| | Gradation (low tone) | | | | Maximum density |
|---|---|---|---|---|---|
| | 255 | 200 | 175 | 150 | 0 |
| Example 1 | 0.17 | 0.21 | 0.3 | 0.39 | 1.53 |
| Example 2 | 0.15 | 0.18 | 0.25 | 0.32 | 1.51 |
| Example 3 | 0.16 | 0.21 | 0.31 | 0.42 | 1.4 |
| Comparative Example 1 | 0.2 | 0.26 | 0.38 | 0.48 | 1.4 |
| Comparative Example 2 | 0.17 | 0.21 | 0.31 | 0.41 | 1.21 |

The sublimation thermal transfer recording media of Examples and Comparative Examples were evaluated for the maximum density in the aforementioned printing test and reproduction of complexion of human. The results are shown in Table 3 below. The evaluation of complexion was made by additionally forming magenta and yellow thermal transfer dye layers in the same manner to attain full color image printing. The reproduction of complexion was evaluated by three grades, namely, the case where the dye was appropriately transferred in low energy regions to reproduce delicate nuance of complexion (A), the case where complexion was reproduced without uncomfortable feeling (B), and the dye was transferred in a too large amount in low energy regions to cause uncomfortable feeling as complexion (C). The maximum density was evaluated by three grades, namely, the case where a reflection density of 1.5 or more was realized at zero tone (A), the case where a reflection density of 1.4 or more was realized (B), and the case where the reflection density was less than 1.4 (C).

TABLE 3

| | Complexion of human | Maximum density |
|---|---|---|
| Example 1 | B | A |
| Example 2 | A | A |
| Example 3 | B | B |
| Comparative Example 1 | C | B |
| Comparative Example 2 | B | C |

It is understood from the results shown in the tables and figure that good gradation printing is realized, and a sufficient printing density is obtained at high energy in Examples according to an embodiment of the present invention. On the other hand, the dye transfer is excessive in low energy regions to deteriorate reproduction of complexion in Comparative Example 1 using the graft type releasing agent, and the maximum density is insufficient in Comparative Example 2 using the binder resin having a larger molecular weight.

As described in the foregoing, according to an embodiment of the present invention, background stain can be removed, and gradation printing with high accuracy and good correlation between the heat quantity applied and the coloring density can be realized. Furthermore, effectively no problem associated with separation of a dye and repelling thereof upon forming a thermal transfer dye layer occurs.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A sublimation thermal transfer recording medium comprising a base sheet having formed on one surface thereof a plurality of thermal transfer dye layers having different hues in parallel to each other, the thermal transfer dye layers containing a resin material having a weight average molecular Mw of about 100,000 or less and containing a block copolymer silicone resin.

2. The sublimation thermal transfer recording medium of claim 1, wherein the resin material has a weight average molecular weight Mw of about 60,000 or less.

3. The sublimation thermal transfer recording medium of claim 1, wherein the block copolymer silicone resin includes an amount of Si that ranges from about 5% to about 30% by weight.

4. The sublimation thermal transfer recording medium of claim 1, wherein a mixing ratio of the resin material and the block copolymer silicone resin ranges from about 99:1 to about 70:30.

5. A thermal transfer recording method comprising:

producing a receiving material in contact with a sublimation thermal transfer recording medium; and applying heat to a back surface of the sublimation thermal transfer recording medium to effect printing on the receiving material, wherein the sublimation thermal transfer recording medium includes a thermal transfer dye layer that includes a resin material having a weight average molecular Mw of about 100,000 or less and containing a block copolymer silicone resin, and wherein the receiving material includes a soft vinyl chloride card such that printing is effected directly on a surface thereof.

* * * * *